US009780456B2

(12) United States Patent
Tao

(10) Patent No.: US 9,780,456 B2
(45) Date of Patent: Oct. 3, 2017

(54) ANTENNA SYSTEM

(71) Applicant: Wistron NeWeb Corp., Hsinchu (TW)

(72) Inventor: Yu Tao, Hsinchu (TW)

(73) Assignee: Wistron Neweb Corp., Hsinchu (TW)

( * ) Notice: Subject to any disclaimer, the term of this patent is extended or adjusted under 35 U.S.C. 154(b) by 57 days.

(21) Appl. No.: 14/926,404

(22) Filed: Oct. 29, 2015

(65) Prior Publication Data

US 2016/0322709 A1 Nov. 3, 2016

(30) Foreign Application Priority Data

Apr. 30, 2015 (TW) ..... 104113848 A

(51) Int. Cl.

| | |
|---|---|
| ***H01Q 9/16*** | (2006.01) |
| ***H01Q 9/06*** | (2006.01) |
| ***H01Q 1/52*** | (2006.01) |
| ***H01Q 5/48*** | (2015.01) |

(52) U.S. Cl.
CPC ..... *H01Q 9/065* (2013.01); *H01Q 1/521* (2013.01); *H01Q 5/48* (2015.01)

(58) Field of Classification Search
CPC ..... H01Q 5/48; H01Q 1/52; H01Q 9/065
USPC ..... 343/806
See application file for complete search history.

(56) References Cited

U.S. PATENT DOCUMENTS 6,417,816 B2 * 7/2002 Sadler ..... H01Q 1/243 343/702
6,961,028 B2 11/2005 Joy et al.
7,098,856 B2 8/2006 Okado
7,106,259 B2 * 9/2006 Tseng ..... H01Q 1/243 343/700 MS
7,242,352 B2 7/2007 Tavassoli Hozouri
7,385,556 B2 * 6/2008 Chung ..... H01Q 1/38 343/700 MS
7,501,991 B2 * 3/2009 Yeap ..... H01Q 1/38 343/700 MS
8,063,845 B2 * 11/2011 Rabinovich ..... H01Q 1/3241 343/713
8,400,364 B2 * 3/2013 Kotaka ..... H01Q 1/243 343/700 MS
8,493,215 B2 * 7/2013 Tada ..... G06K 19/07749 340/572.7

(Continued)

FOREIGN PATENT DOCUMENTS

TW 527749 B 4/2003
TW M331199 U 4/2008

*Primary Examiner* — Huedung Mancuso
(74) *Attorney, Agent, or Firm* — Muncy, Geissler, Olds & Lowe, P.C.

(57) ABSTRACT

An antenna system includes a first dipole antenna element and a second dipole antenna element. The first dipole antenna element includes a first feeding radiation element and a first grounding radiation element. The first feeding radiation element has an extension portion. The first grounding radiation element has an open slot. The extension portion extends into the interior of the open slot. The second dipole antenna element includes a second feeding radiation element and a second grounding radiation element. The first dipole antenna element and the second dipole antenna element are both excited by a signal source. The first dipole antenna element operates in a low-frequency band. The second dipole antenna element operates in a high-frequency band.

18 Claims, 4 Drawing Sheets

(56) References Cited

U.S. PATENT DOCUMENTS

| | | | | |
|---|---|---|---|---|
| 8,654,014 | B2 * | 2/2014 | Ling | H01Q 1/243<br>343/700 MS |
| 8,711,050 | B2 * | 4/2014 | Chiu | H01Q 9/285<br>343/795 |

* cited by examiner

ANTENNA SYSTEM

CROSS REFERENCE TO RELATED APPLICATIONS

This Application claims priority of Taiwan Patent Application No. 104113848 filed on Apr. 30, 2015, the entirety of which is incorporated by reference herein.

BACKGROUND OF THE INVENTION

Field of the Invention

The disclosure generally relates to an antenna system, and more particularly to an antenna system with high gain characteristics.

Description of the Related Art

With the progress of mobile communication technology, portable electronic devices, such as portable computers, mobile phones, tablet computers, multimedia players, and other hybrid functional mobile devices, have become more common. To satisfy consumer demand, portable electronic devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

Antennas are indispensable elements in the wireless communication field. If the antenna gain of an antenna for signal reception or transmission is insufficient, the communication quality of the related mobile device will be degraded accordingly. Therefore, it is a critical challenge for antenna designers to design antenna elements with high gain characteristics.

BRIEF SUMMARY OF THE INVENTION

In one exemplary embodiment, the disclosure is directed to an antenna system including a first dipole antenna element and a second dipole antenna element. The first dipole antenna element includes a first feeding radiation element and a first grounding radiation element. The first feeding radiation element has an extension portion. The first grounding radiation element has an open slot. The extension portion extends into the interior of the open slot. The second dipole antenna element includes a second feeding radiation element and a second grounding radiation element. The first dipole antenna element and the second dipole antenna element are both excited by a signal source. The first dipole antenna element operates in a low-frequency band. The second dipole antenna element operates in a high-frequency band.

In some embodiments, the antenna system further includes a second meandering connection line, a second cascading radiation element, a third meandering connection line, and a third cascading radiation element. The second cascading radiation element is coupled through the second meandering connection line to the second feeding radiation element. The third cascading radiation element is coupled through the third meandering connection line to the second grounding radiation element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1:
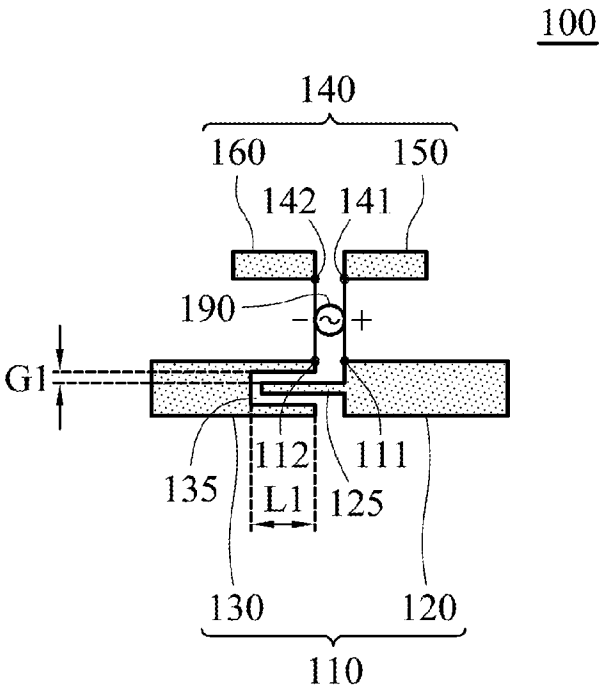
FIG. 1 is a diagram of an antenna system according to an embodiment of the invention.

FIG. 1 is a diagram of an antenna system 100 according to an embodiment of the invention. The antenna system 100 may be made of a metal material, and may be disposed on a dielectric substrate, such as a PCB (Printed Circuit Board) or an FR4 (Flame Retardant 4) substrate. As shown in FIG. 1, the antenna system 100 at least includes a first dipole antenna element 110 and a second dipole antenna element 140. The first dipole antenna element 110 and the second dipole antenna element 140 are both excited by the same signal source 190. The signal source 190 may be an RF (Radio Frequency) module. The first dipole antenna element 110 operates in a low-frequency band, and the second dipole antenna element 140 operates in a high-frequency band. For example, the low-frequency band may be from about 2400 MHz to about 2500 MHz, and the high-frequency band may be from about 5150 MHz to about 5850 MHz, such that the antenna system 100 can support the dual-band operation of Wi-Fi and Bluetooth.

The first dipole antenna element 110 includes a first feeding radiation element 120 and a first grounding radiation element 130. The second dipole antenna element 140 includes a second feeding radiation element 150 and a second grounding radiation element 160. Each of the first feeding radiation element 120 and the first grounding radiation element 130 may substantially have a relatively long rectangular shape. Each of the second feeding radiation element 150 and the second grounding radiation element 160 may substantially have a relatively short rectangular shape (e.g., the length of the relatively long rectangular shape may be two times the length of the relatively short rectangular shape). A first feeding point 111 on the first feeding radiation element 120 and a second feeding point 141 on the second feeding radiation element 150 are both coupled to a positive electrode of the signal source 190. A first grounding point 112 on the first grounding radiation element 130 and a second grounding point 142 on the second grounding radiation element 160 are both coupled to a negative electrode of the signal source 190. The first feeding radiation element 120 has an extension portion 125. The width of the extension portion 125 is narrower than the width of the other portion of the first feeding radiation element 120. The first grounding radiation element 130 has an open slot 135. The first feeding point 111 is adjacent to the extension portion 125. The first grounding point 112 is adjacent to the open slot 135. The extension portion 125 may substantially have a relatively narrow straight-line shape, and the open slot 135 may substantially have a relatively wide straight-line shape. The extension portion 125 extends into the interior of the open slot 135. The element sizes may be as follows. Each of the first feeding radiation element 120 and the first grounding radiation element 130 has a length which is substantially equal to ¼ wavelength ($\lambda/4$) of a central operating frequency of the low-frequency band. Each of the second feeding radiation element 150 and the second grounding radiation element 160 has a length which is substantially equal to ¼ wavelength (λ/4) of a central operating frequency of the high-frequency band. The length L1 of the open slot 135 is shorter than ⅛ wavelength (λ/8) of the central operating frequency of the low-frequency band. The spacing G1 between the extension portion 125 and the edge of the open slot 135 is shorter than 1 mm (e.g., the preferred spacing G1 is equal to 0.5 mm).

In the invention, the extension portion 125 and the open slot 135 are configured to prevent the currents in the high-frequency band from affecting the first dipole antenna element 110. Specifically, the extension portion 125 and the open slot 135 form an effective capacitor, which has a relatively median capacitance. For the low-frequency band, the effective capacitor is considered an open circuit, and therefore it does not affect the current distribution of the first dipole antenna element 110. For the high-frequency band, the effective capacitor is considered a closed circuit, and therefore the currents in the high-frequency band flow from the second feeding radiation element 150 to the first feeding radiation element 110 and then through the short-circuited path of the extension portion 125 and the open slot 135 finally back to the second grounding radiation element 160. The design of the invention can solve a problem in the prior art wherein high-frequency and low-frequency radiators of a conventional high-gain antenna tend to interfere with each other. Furthermore, there is no need to use an additional frequency divider (with insertion loss). Accordingly, the invention has at least the advantages of improving the radiation performance of the antenna, reducing insertion loss, and decreasing total manufacturing costs, and it is suitable for application in a variety of wideband antenna structures.

Figure 2:
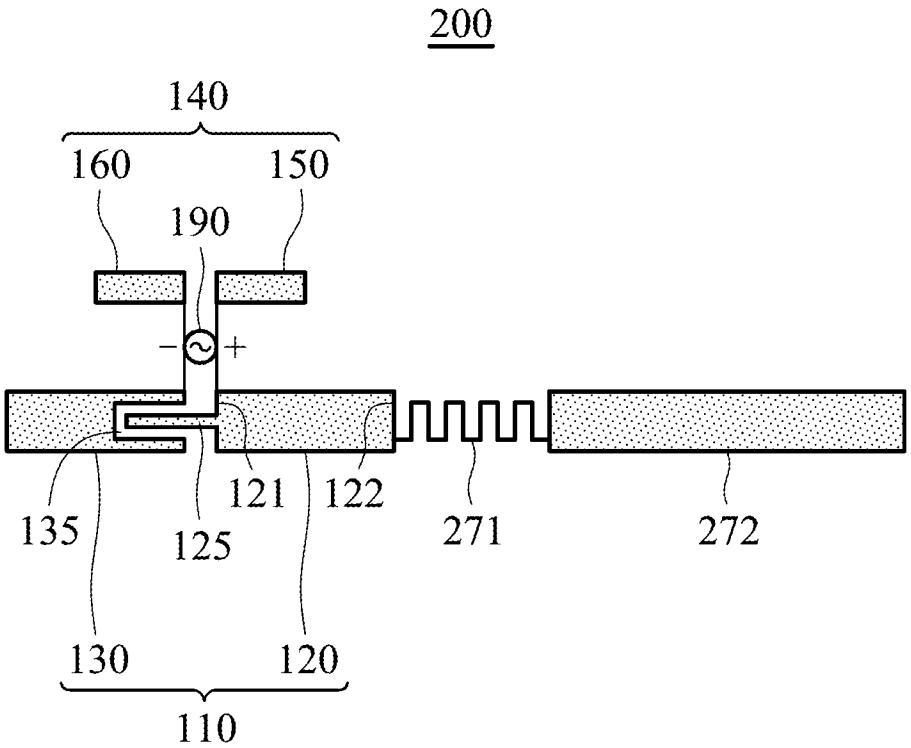
FIG. 2 is a diagram of an antenna system according to an embodiment of the invention.

FIG. 2 is a diagram of an antenna system 200 according to an embodiment of the invention. FIG. 2 is similar to FIG. 1. The difference between the two embodiments is that the antenna system 200 of FIG. 2 further includes a first meandering connection line 271 and a first cascading radiation element 272. The first cascading radiation element 272 is coupled through the first meandering connection line 271 to the first feeding radiation element 120. Specifically, the extension portion 125 is positioned at a first edge 121 of the first feeding radiation element 120, and the first meandering connection line 271 is coupled to a second edge 122 of the first feeding radiation element 120. The first edge 121 and the second edge 122 of the first feeding radiation element 120 are opposite to each other. The first meandering connection line 271 substantially has a combination of one or more W-shapes. The first cascading radiation element 272 substantially has a rectangular shape. The length of the first meandering connection line 271 (i.e., the total length of the straightened first meandering connection line 271) may be substantially equal to ½ wavelength (λ/2) of the central operating frequency of the low-frequency band. The length of the first cascading radiation element 272 may be substantially equal to ½ wavelength (λ/2) of the central operating frequency of the low-frequency band. With such a design, it may be considered that the antenna system 200 includes an antenna array formed by the first dipole antenna element 110, the first meandering connection line 271, and the first cascading radiation element 272. The first dipole antenna element 110 may be configured as the main radiator of the antenna array. The first meandering connection line 271 may generate negative-phase radiation, and the first cascading radiation element 272 may generate positive-phase radiation. Since the first meandering connection line 271 has a dense and tortuous current path, any two adjacent segments of the first meandering connection line 271 have surface currents in opposite directions. As a result, from a far reference point, the aforementioned negative-phase radiation can be almost completely eliminated. On the other hand, the positive-phase radiation of the first cascading radiation element 272 can constructively interfere with the radiation of the first dipole antenna element 110, such that the total gain of the antenna array can be enhanced. In other embodiments, the antenna array includes more meandering connection lines and more cascading radiation elements, and it is not limited to the configuration of FIG. 2. Other features of the antenna system 200 of FIG. 2 are similar to those of the antenna system 100 of FIG. 1. Therefore, the two embodiments can achieve similar levels of performance.

Figure 3:
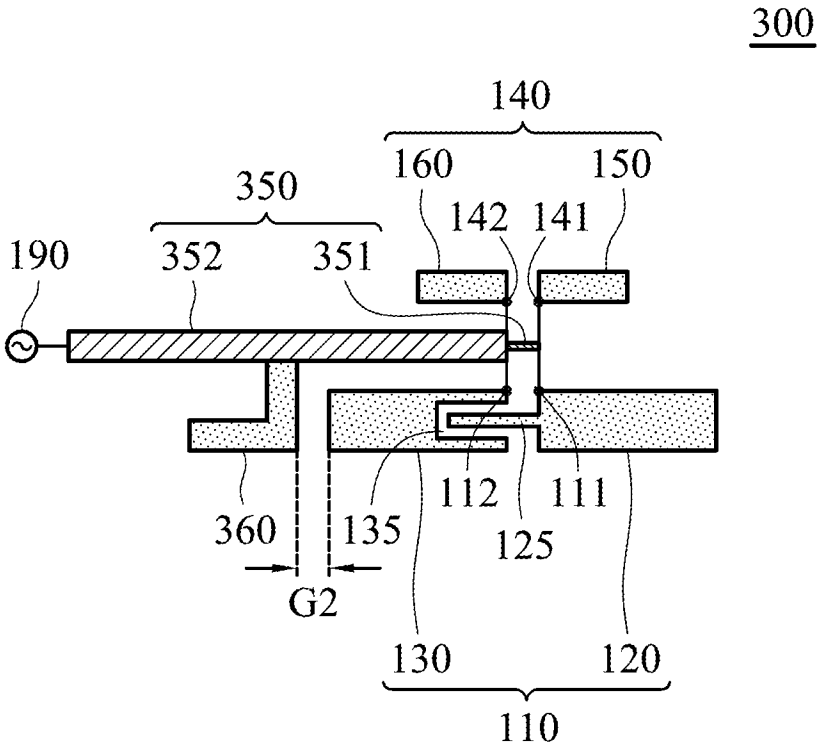
FIG. 3 is a diagram of an antenna system according to an embodiment of the invention.

FIG. 3 is a diagram of an antenna system 300 according to an embodiment of the invention. FIG. 3 is similar to FIG. 1. The difference between the two embodiments is that the antenna system 300 of FIG. 3 further includes a coaxial cable 350 and a return current suppression element 360. The coaxial cable 350 includes a central conductive line 351 and a conductive housing 352. The positive electrode of the signal source 190 is coupled through the central conductive line 351 to the first feeding point 111 and the second feeding point 141. The negative electrode of the signal source 190 is coupled through the conductive housing 352 to the first grounding point 112 and the second grounding point 142. The return current suppression element 360 is coupled to the conductive housing 352. The return current suppression element 360 substantially has an L-shape. The length of the return current suppression element 360 is substantially equal to ¼ wavelength (λ/4) of the central operating frequency of the low-frequency band. The spacing G2 between the return current suppression element 360 and the first dipole antenna element 110 is from about 2 mm to about 3 mm. The return current suppression element 360 is configured to attract the currents from the conductive housing 352, so as to prevent the coaxial cable 350 from generating radiation. With such a design, the return currents of the coaxial cable 350 gather on the return current suppression element 360 and form standing waves. As a result, the return current suppression element 360 can effectively prevent the coaxial cable 350 from radiating to and interfering with the first dipole antenna element 110. Other features of the antenna system 300 of FIG. 3 are similar to those of the antenna system 100 of FIG. 1. Therefore, the two embodiments can achieve similar levels of performance.

Figure 4:
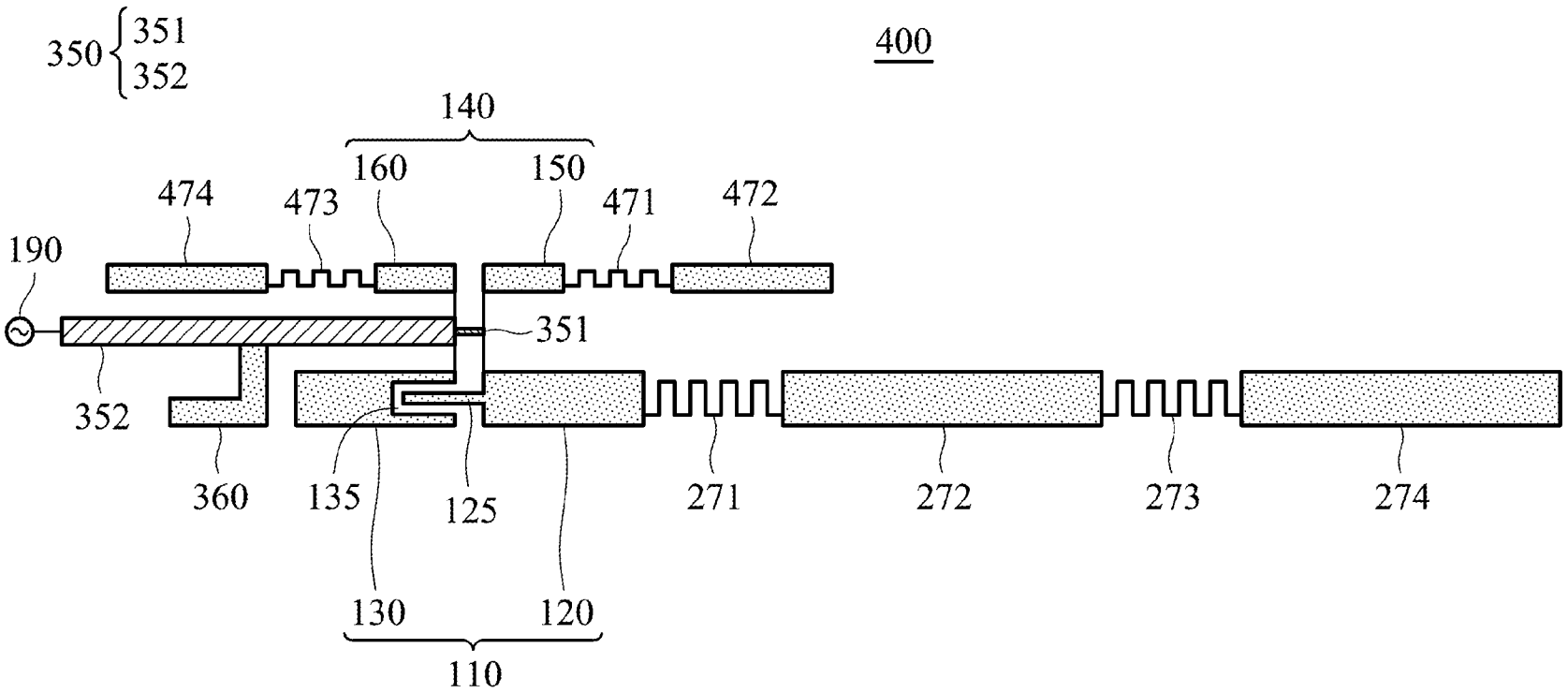
FIG. 4 is a diagram of an antenna system according to an embodiment of the invention.

FIG. 4 is a diagram of an antenna system 400 according to an embodiment of the invention. FIG. 4 is similar to FIG. 1, FIG. 2, and FIG. 3. The difference between these embodiments is that the antenna system 400 of FIG. 4 further includes a second meandering connection line 471, a second cascading radiation element 472, a third meandering connection line 473, and a third cascading radiation element 474, a fourth meandering connection line 273, and a fourth cascading radiation element 274. The second cascading radiation element 472 is coupled through the second meandering connection line 471 to the second feeding radiation element 150. The third cascading radiation element 474 is coupled through the third meandering connection line 473 to the second grounding radiation element 160. Each of the second meandering connection line 471 and the third meandering connection line 473 has a length (i.e., the total length of the straightened second meandering connection line 471 or the total length of the straightened third meandering connection line 473) which is substantially equal to ½ wavelength (λ/2) of a central operating frequency of the high-frequency band. Each of the second cascading radiation element 472 and the third cascading radiation element 474 has a length which is substantially equal to ½ wavelength (λ/2) of the central operating frequency of the high-frequency band. The fourth cascading radiation element 274 is coupled through the fourth meandering connection line 273 to the first cascading radiation element 272. The length of the fourth meandering connection line 273 (i.e., the total length of the straightened fourth meandering connection line 273) may be substantially equal to ½ wavelength (λ/2) of the central operating frequency of the low-frequency band. The length of the fourth cascading radiation element 274 may be substantially equal to ½ wavelength (λ/2) of the central operating frequency of the low-frequency band. The above additional meandering connection lines and cascading radiation elements are configured to further enhance the antenna gain of the antenna system 400. Other features of the antenna system 400 of FIG. 4 are similar to those of the antenna systems 100, 200, and 300 of FIG. 1, FIG. 2, and FIG. 3. Therefore, these embodiments can achieve similar levels of performance.

In conclusion, the invention provides an antenna system which has the characteristics of high gain, low insertion loss, low inter-band interference, and low coaxial cable radiation. The invention has a simple structure, and it can be easily implemented in a variety of communication devices and have commercial values of mass production.

It should be noted that the above element sizes, element parameters, element shapes, and frequency ranges are not limitations of the invention. An antenna engineer can adjust these settings or values according to different requirements. It should be understood that the antenna system of the invention is not limited to the configurations of FIGS. 1-4. The invention may merely include any one or more features of any one or more embodiments of FIGS. 1-4. In other words, not all of the features shown in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it is to be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna system, comprising:

a first dipole antenna element, comprising a first feeding radiation element and a first grounding radiation element, wherein the first feeding radiation element has an extension portion, the first grounding radiation element has an open slot, and the extension portion extends into an interior of the open slot;

a second dipole antenna element, comprising a second feeding radiation element and a second grounding radiation element;

a first meandering connection line; and a first cascading radiation element, coupled through the first meandering connection line to the first feeding radiation element, wherein the first dipole antenna element and the second dipole antenna element are both excited by a signal source, the first dipole antenna element operates in a low-frequency band, and the second dipole antenna element operates in a high-frequency band, wherein a first feeding point on the first feeding radiation element and a second feeding point on the second feeding radiation element are both coupled to a positive electrode of the signal source, and a first grounding point on the first grounding radiation element and a second grounding point on the second grounding radiation element are both coupled to a negative electrode of the signal source.

2. The antenna system as claimed in claim 1, wherein each of the first feeding radiation element, the first grounding radiation element, the second feeding radiation element, and the second grounding radiation element substantially has a rectangular shape.

3. The antenna system as claimed in claim 1, wherein the extension portion substantially has a relatively narrow straight-line shape, and the open slot substantially has a relatively wide straight-line shape.

4. The antenna system as claimed in claim 1, wherein a length of the open slot is shorter than ⅛ wavelength of a central operating frequency of the low-frequency band.

5. The antenna system as claimed in claim 1, wherein spacing between the extension portion and an edge of the open slot is shorter than 1 mm.

6. The antenna system as claimed in claim 1, wherein the extension portion and the open slot are configured to prevent currents in the high-frequency band from affecting the first dipole antenna element.

7. The antenna system as claimed in claim 1, wherein the first feeding point is adjacent to the extension portion, and the first grounding point is adjacent to the open slot.

8. The antenna system as claimed in claim 1, wherein the extension portion is positioned at a first edge of the first feeding radiation element, the first meandering connection line is coupled to a second edge of the first feeding radiation element, and the first edge and the second edge of the first feeding radiation element are opposite to each other.

9. The antenna system as claimed in claim 1, wherein the first meandering connection line substantially has a combination of one or more W-shapes.

10. The antenna system as claimed in claim 1, wherein the first cascading radiation element substantially has a rectangular shape.

11. The antenna system as claimed in claim 1, wherein a length of the first meandering connection line is substantially equal to ½ wavelength of a central operating frequency of the low-frequency band.

12. The antenna system as claimed in claim 1, wherein a length of the first cascading radiation element is substantially equal to ½ wavelength of a central operating frequency of the low-frequency band.

13. The antenna system as claimed in claim 1, further comprising:

a coaxial cable, comprising a central conductive line and a conductive housing, wherein the positive electrode of the signal source is coupled through the central conductive line to the first feeding point and the second feeding point, and the negative electrode of the signal source is coupled through the conductive housing to the first grounding point and the second grounding point.

14. The antenna system as claimed in claim 13, further comprising:

a return current suppression element, coupled to the conductive housing, wherein the return current suppression element attracts currents from the conductive housing, so as to prevent the coaxial cable from generating radiation.

15. The antenna system as claimed in claim 14, wherein the return current suppression element substantially has an L-shape.

16. The antenna system as claimed in claim 14, wherein a length of the return current suppression element is substantially equal to ¼ wavelength of a central operating frequency of the low-frequency band.

17. The antenna system as claimed in claim 14, wherein spacing between the return current suppression element and the first dipole antenna element is from about 2 mm to about 3 mm.

18. The antenna system as claimed in claim 1, further comprising:

a second meandering connection line;

a second cascading radiation element, coupled through the second meandering connection line to the second feeding radiation element;

a third meandering connection line; and a third cascading radiation element, coupled through the third meandering connection line to the second grounding radiation element.

* * * * *